United States Patent [19]

Ono

[11] Patent Number: 4,893,020

[45] Date of Patent: Jan. 9, 1990

[54] X-RAY FLUORESCENT IMAGE INTENSIFIER

[75] Inventor: Katsuhiro Ono, Kawasaki, Japan

[73] Assignee: Kabushiki Kaisha Toshiba, Kawasaki, Japan

[21] Appl. No.: 134,157

[22] Filed: Dec. 17, 1987

[30] Foreign Application Priority Data

Dec. 18, 1986 [JP] Japan ..... 61-299984

[51] Int. Cl.[4] ..... H01J 31/50

[52] U.S. Cl. ..... 250/483.1; 260/213 VT

[58] Field of Search ..... 250/488.1, 486.1, 483.1, 250/213 VT

[56] References Cited

U.S. PATENT DOCUMENTS

| | | | |
|---|---|---|---|
| 3,041,456 | 11/1956 | MacLeod | 250/486.1 |
| 3,344,276 | 9/1967 | Balding | 378/190 |
| 3,573,459 | 4/1971 | Siegmund | 250/483.1 |
| 3,717,764 | 2/1973 | Fujimura et al. | 250/486.1 |
| 3,783,299 | 5/1972 | Houston | 250/483.1 |
| 3,825,763 | 7/1974 | Ligtenberg et al. | 250/486.1 |
| 4,415,810 | 11/1983 | Brown, Sr. | 250/484.1 |
| 4,626,694 | 12/1986 | Sano et al. | 250/483.1 |

FOREIGN PATENT DOCUMENTS

| | | | |
|---|---|---|---|
| 257610 | 5/1963 | Australia | 250/213 VT |
| 70784 | 6/1977 | Japan | 250/483.1 |
| 55-21805 | 2/1980 | Japan . | |
| 55729 | 11/1986 | Japan . | |

*Primary Examiner*—Constantine Hannaher

*Attorney, Agent, or Firm*—Cushman, Darby & Cushman

[57] ABSTRACT

An X-ray fluorescent image intensifier is disclosed, which comprises an input screen for converting an incident X-ray image into photoelectrons, electrodes for accelerating and focusing photoelectrons and an output screen for converting the accelerated and focused photoelectrons. The input screen consists of an input substrate consisting of a lamination of a plurality of mesh plates each having a plurality of apertures, said input substrate having a plurality of through holes consisting of an interconnection of said apertures, and phosphor buried in said through holes, and a photocathode formed on said input substrate with phosphor buried in said through holes.

11 Claims, 9 Drawing Sheets

X-RAY FLUORESCENT IMAGE INTENSIFIER

BACKGROUND OF THE INVENTION

This invention relates to an X-ray fluorescent image intensifier and, more particularly, to improvements in an input section of such intensifier.

A usual object observation system using an X-ray fluorescent image intensifier is as shown in FIG. 1. As is shown, ahead of X-ray tube 1 is disposed X-ray fluorescent image intensifier 2. X-rays having been transmitted and modulated through object 3 are incident on X-ray fluorescent image intensifier 2. An output image of X-ray fluorescent image intensifier 2 is picked up by a television camera (not shown) to be reproduced on a monitoring television (not shown).

X-ray fluorescent image intensifier 2 has input screen 4 provided at the front end and output screen 5 provided at the rear end and facing input section 4. In the operation of X-ray fluorescent image intensifier 2, the modulated X-ray image on input screen 4 is converted into optical image and then into a photoelectron image. The photoelectron image is focused and accelerated to reach output screen 5, at which an optical output image with intensified brightness can be obtained. This optical output image is picked up by a television camera, for instance.

The input screen of such a prior art X-ray fluorescent image intensifier 2 has a structure as shown in FIG. 2. As is shown, on the concave surface of aluminum substrate 6 having a spherical surface is formed phosphor layer 8 consisting of columnar crystals 7 of sodium iodide-activated cesium iodide phosphor. Intermediate layer 9 consisting of an aluminum oxide layer and an indium oxide layer is formed on phosphor layer 8, and photocathode 10 is formed on phosphor layer 9.

In an object observation system using the above X-ray fluorescent image intensifier, it is desired to reduce the amount of X-rays illuminating object 3. In order to obtain satisfactory brightness and resolution with such a small quantity of X-rays, it is necessary to permit X-rays having been transmitted through object 3 to be incident on the phosphor layer without loss to increase the absorbed X-rays. To this end, the quantity of X-rays absorbed in aluminum substrate 6 is as small as possible, and it is most desirable to omit aluminum substrate 6. With the prior art screen structure, however, it is impossible to omit aluminum substrate 6.

In order to increase the quantity of X-rays absorbed in the phosphor layer, columnar crystals 7 desirably have as large length as possible. Where the length of columnar crystals 7 is increased, however, the number of times of refraction of light in phosphor layer 8 is increased to increase the quantity of light propagated from the side surface of a columnar crystals to an adjacent one. This reduces the resolution. For this reason, the length of columnar crystals 7 can not be increased too much, and its upper limit is approximately 400 μm.

Further, with the prior art phosphor layer 8 phosphor is evaporatedly deposited on the concave surface of aluminum substrate 6, so that the grown columnar crystals 7 are directed in directions crossing the central axis of aluminum substrate 6. Since this direction crosses the direction of incidence of X-rays, with increase of the length of columnar crystals 7, in peripheral portions of the input screen a plurality of columnar crystals 7 adjacent to one another are caused to fluoresce simultaneously with incidental X-rays on the same route. Thus, the resolution is reduced. Further, since intermediate layer 9 is an evaporated layer consisting of aluminum oxide and indium oxide, it has a large number of light reflection points to reduce the resolution.

Further, phosphor layer 8 consisting of columnar crystals 7 has inferior light transmittance compared to the phosphor layer formed by the melting, so that the sensitivity is inferior. Further, the phosphor layer 8 consisting of columnar crystals 7 has a large number of fine surface irregularities, so that electrons from photocathode 10 formed on phosphor layer 8 are emitted in various directions. Therefore, the electrons are not satisfactorily focused, and the resolution is reduced.

Further, scattered X-rays radiated from object 3 and evacuated envelopes in the neighborhood of input screen 4 are absorbed in columnar crystals 7 of phosphor layer 8 to reduce the contrast.

To solve the above problems, there has been proposed a fluorescent image intensifier having an input phosphor screen, which consists of a honeycomb-like supporting plate of a heavy metal having a plurality of apertures defined by partition walls and phosphor material filling the apertures (as disclosed in Japanese Patent Disclosure No. 55–21805). According to this publication, the honeycomb-like supporting plate is formed with holes using an electron beam or a laser beam. With this method, however, a processing time of 2,600 hours or more is required for manufacturing a honeycomb-like supporting plate with a diameter of 12 inches, for instance. This is impractical.

SUMMARY OF THE INVENTION

An object of the invention is to provide an X-ray fluorescent image intensifier, which permits avoiding the reduction of the resolution and improving the sensitivity.

Another object of the invention is to provide a method of easily and inexpensively manufacturing such an X-ray fluorescent image intensifier.

As a first embodiment of the invention, there is provided an X-ray fluorescent image intensifier, which comprises an input screen for converting incident X-ray image into photoelectrons, means for accelerating and focusing said photoelectrons, and an output screen for converting said accelerated and focused photoelectrons into an optical image, said input screen including an input substrate which is constituted by a lamination of a plurality of mesh plates having a plurality of apertures and has a plurality of through holes constituted by interconnection of said apertures, phosphor buried in said through holes and a photocathode formed on said input substrate with phosphor buried in said through holes.

The pitch a (center-to-center spacing) of apertures formed in the mesh plate is preferably 10 to 200 μm, more preferably 50 to 150 μm. Further, the thickness W of walls defining individual apertures is suitably 2 to 10 μm.

The pitch of apertures may be gradually increased toward the photoelectric screen so that the through holes are directed toward the X-ray source. By so doing, direct X-rays can be perfectly isolated and absorbed by the phosphor.

The pitch of the apertures may be made the same for all the mesh plates. In this case, the manufacture is facilitated to reduce cost. Further, it is possible to vary the pitch of apertures formed in a single mesh plate.

Further, like apertures in adjacent mesh plates may not be aligned but may be arranged at random. In this case, though X-ray cannot be perfectly isolated, it is possible to reduce cost because there is no need of alignment.

The mesh plate may be obtained by photoetching the metal plate on the both sides. The apertures formed in this way are narrow in the central portion, so that phosphor filling these apertures is not detached. Further, a mesh plate may be obtained by photoetching the metal plate on one side. In such a case, it is possible to secure phosphor by forming a reinforcing plate on the side of incidence of X-rays.

The input substrate is formed by stacking a plurality of mesh plates and welding predetermined portions of these mesh plates. The method of welding is suitably solid-state welding, and solid-state welding is suitably diffusion welding. Diffusion welding is a method of pressure contacting two different kinds of metals with an insert metal sandwiched between them at a temperature less than the melting point.

As a second embodiment of the invention, there is provided an X-ray fluorescent image intensifier, which comprises an input section for converting an incident X-ray image into photoelectrons, means for accelerating and focusing said photoelectrons and an output screen for converting said accelerated and focused photoelectrons into an optical image, said input screen including an input substrate having a plurality of through holes and consisting of a mesh plate having a plurality of apertures and a mesh metal layer deposited on said mesh plate, phosphor buried in said through holes and a photocathode formed on said input substrate with phosphor buried in said through holes.

The deposition of the mesh metal layer on the metal plate can be done by means of vacuum evaporation or plating.

Further, it is possible to use a multi-layer structure input substrate by laminating a plurality of input substrates having the above structure.

When the invention is applied to an object observation system, X-rays emitted from an X-ray tube is transmitted through the object to be incident together scattered X-rays generated in the object on an input window of the X-ray fluorescent image intensifier. These X-rays reach an input surface together with scattered X-rays generated in the input window. On the input surface, the scattered X-rays are absorbed by walls directed toward the focal point of the X-ray tube. Thus, X-rays with increased main X-ray ratio causes fluorescence of phosphor filling the through holes defined by the walls. Since the phosphor has a sufficient thickness, incident X-rays can be absorbed by 100%. Since this phosphor is melted, very high light transmittivity and high sensitivity can be obtained. Further, the phosphor in one through hole is optically isolated by substantially continuous walls so that light does not reach other through holes, and crosstalk never occurs. Since the phosphor is surrounded by walls having varying sizes in the thickness direction, such defects as detachment will never occur.

As has been shown, with the X-ray fluorescent image intensifier the MTF at intermediate space frequencies is improved to double the value in the prior art, so that it is possible to obtain an X-ray image having a very high contrast.

DETAILED DESCRIPTION OF THE PREFERRED EMBODIMENT

Now, preferred embodiments of the invention will be described with reference to the accompanying drawings.

Figure 1:
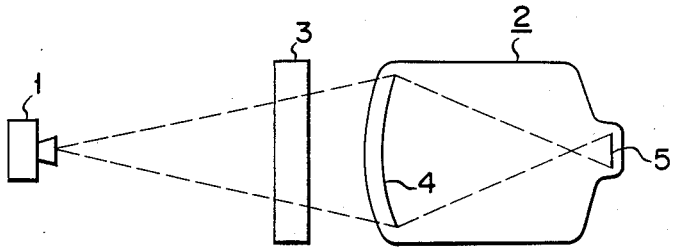
FIG. 1 (PRIOR ART)
FIG. 1 is a schematic view showing an object observation system using a prior art X-ray fluorescent image intensifier.
Figure 2:
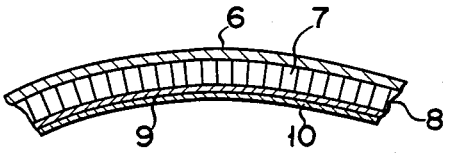
FIG. 2 (PRIOR ART)
FIG. 2 is a fragmentary sectional view showing an input section of a prior art X-ray fluorescent image intensifier.
Figure 3:
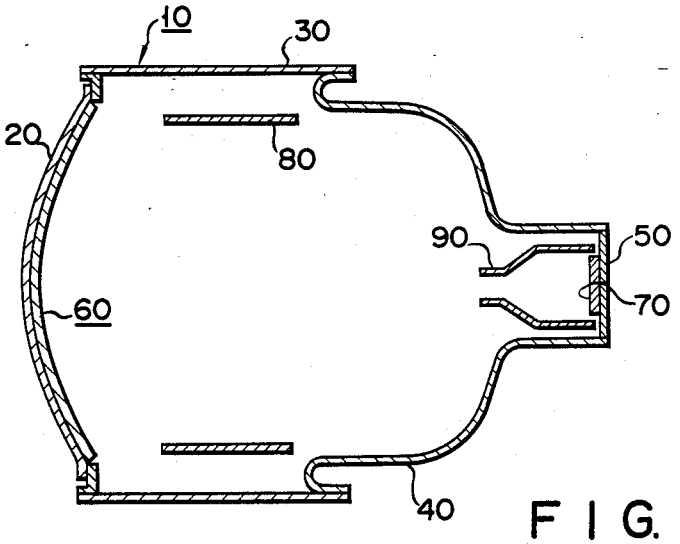
FIG. 3 is a sectional view showing an X-ray fluorescent image intensifier according to the invention.

FIG. 3 is a view schematically showing one embodiment of the X-ray fluorescent image intensifier according to the invention. Referring to FIG. 3, evacuated envelope 10 consists of input window 20 made of an X-ray permeable metal, barrel 30 consisting of a cylindrical metal member hermetically sealed to input window 20 and output end member 50 made of glass hermetically sealed to barrel 30 via cylindrical sealing member 40 made of an iron-nickel cobalt alloy such as KOVAR.

Input screen 60 is provided on the inner side of input window 20 of evacuated envelope 10. Inside output end member 50, there are provided output fluorescent screen 70 and anode 90 facing input screen 60. Focusing electrode 80 is provided coaxially inside barrel 30 of evacuated envelope 10.

In operation, an X-ray image incident on input window 20 is converted by input screen 60 into an electron image. The converted photoelectron image is accelerated and focused by anode electrode 90 and focusing electrode 80 to reach output fluorescent screen 70 to produce a high brightness light image thereon.

Now, various examples of input screen 60, which constitutes an essential element of the invention, will be described in detail with reference to FIGS. 4 to 12.

Figure 4:
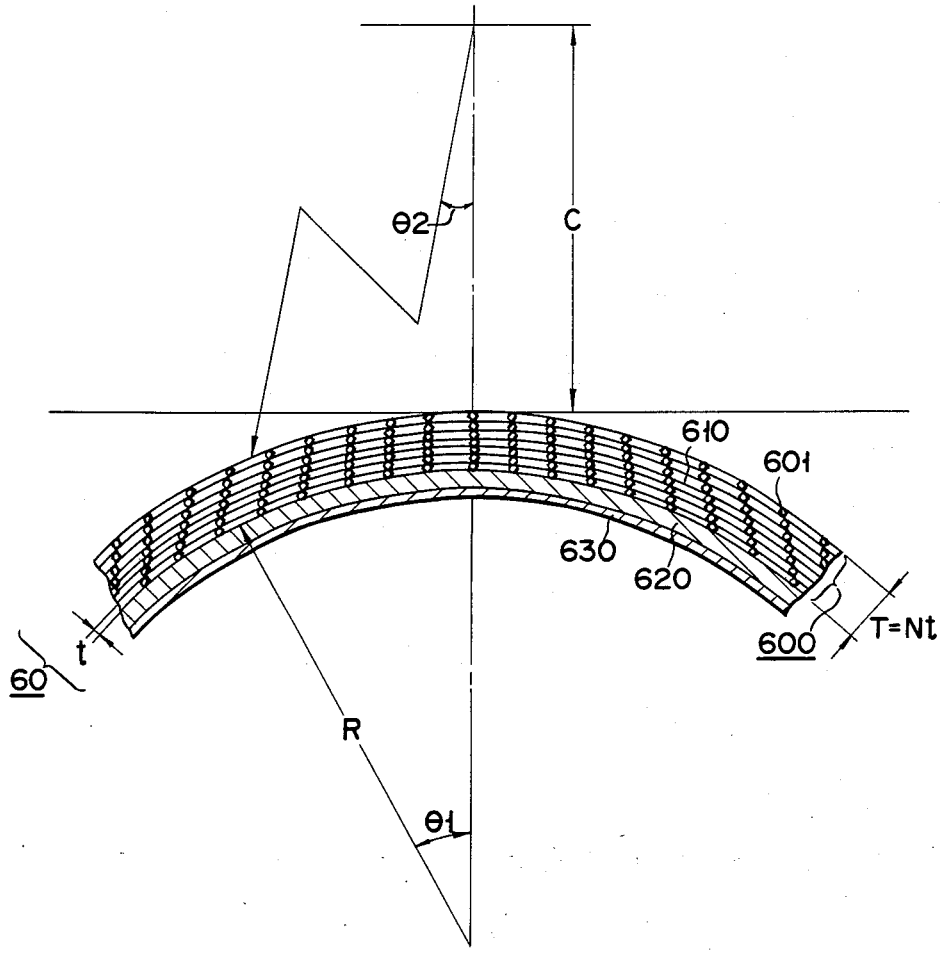
FIG. 4 is a fragmentary sectional view showing an input screen of one embodiment of the X-ray fluorescent image intensifier according to the invention.

Input screen 60, as shown in FIG. 4, consists of fluorescent layer 600, protective layer 620 formed on the concave surface of fluorescent layer 600 and mainly composed of indium oxide and photocathode 630 formed on protective layer 620.

Figure 5:
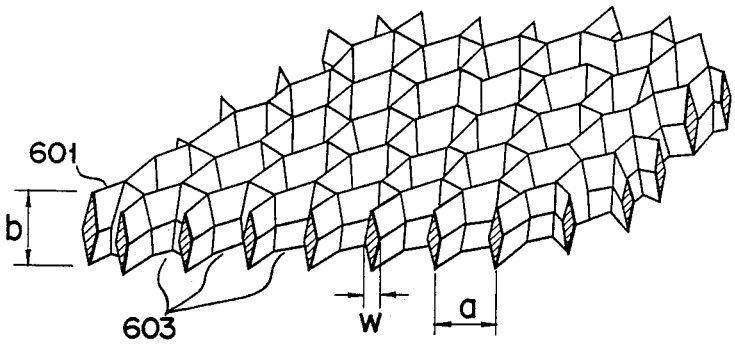
FIG. 5 is a fragmentary perspective view showing a mesh plate constituting the input screen shown in FIG. 4.

In the manufacture of fluorescent layer 600, a thin sheet (not shown) of stainless steel is processed by means of etching into a honeycomb-like mesh plate 601 as shown in the perspective view of FIG. 5. The pitch (center-to-center spacing) of apertures 603 is 50 to 150 μm, the thickness b of mesh plate is 30 to 100 μm. The wall thickness W may be set to 2 to 10 μm.

Figure 6B:
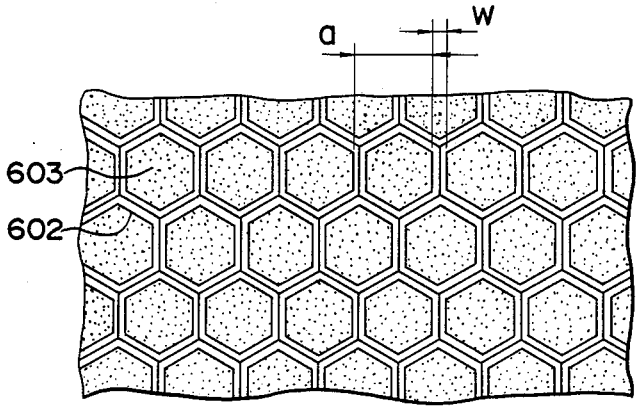
FIG. 6B is a fragmentary sectional view taken along line A—A' in FIG. 6A.
Figure 6A:
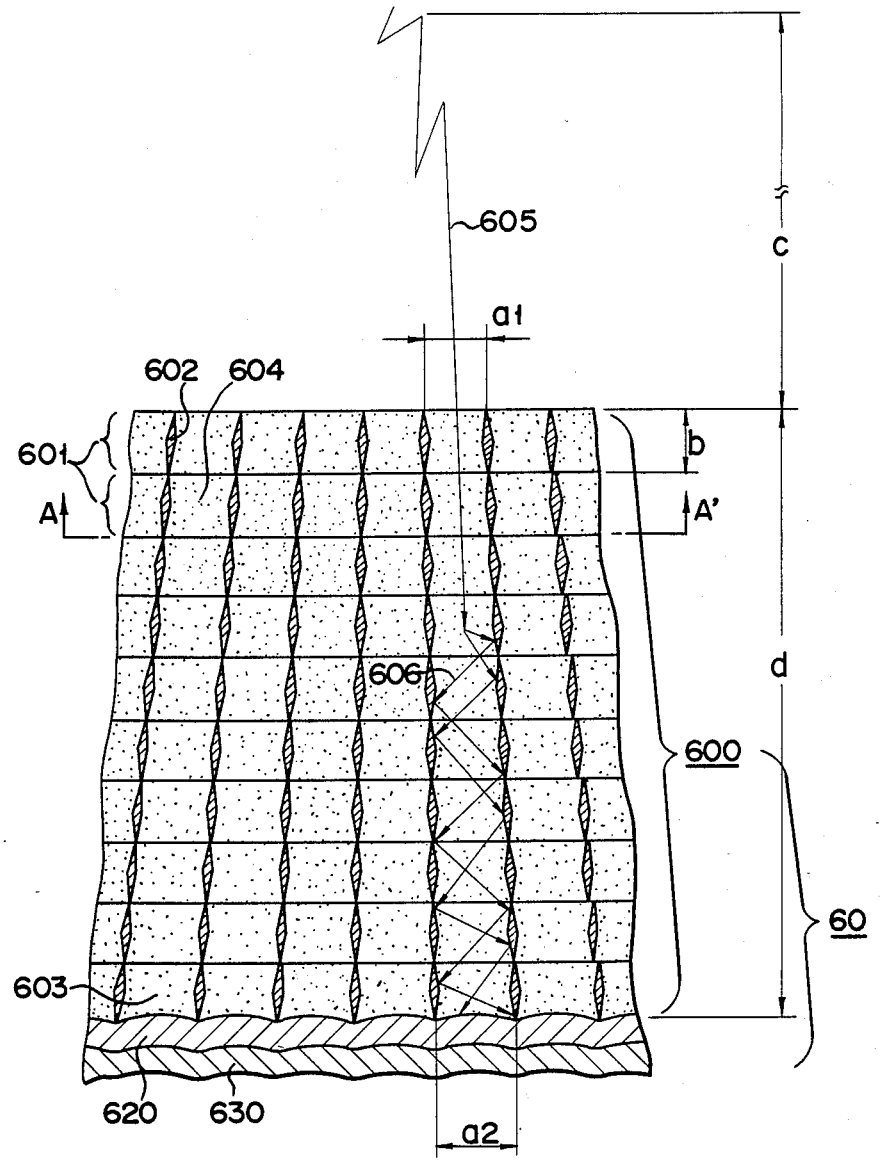
FIG. 6A is a fragmentary perspective view, to an enlarged scale, showing the input screen shown in FIG. 4.

A case will be taken hereinunder, in which a=100 μm, b=50 μm, and w=10 μm. Mesh plate 601 as noted above is processed such that it substantially has a spherical surface. Ten such mesh plates are laminated as shown in FIG. 6A to obtain an input substrate. Walls 602 of mesh plates 601, as shown in FIG. 6A, form a number of tubes which are continuous from first to tenth mesh plates 601. Apertures 603 of mesh plates 601 are continuous from first to tenth mesh plates 601 to form a number of X-ray passages. In this case, apertures 603 of mesh plates 601 are formed by photoetching stainless steel plates. At this time, the same photomask is used to expose the individual stainless steel plates by varying the magnification factor to progressively increase the pitch of apertures 603 of mesh plates 601 from the first to the tenth plate. As a result, apertures 603 formed in the lamination of mesh plates of fluorescent layer 600 are directed as a whole toward the focal point of X-ray tube 1.

Farther, after individual mesh plates 601 have been laminated, they are spot welded together with small spots using a laser beam.

A phosphor, e.g., CsI activated by Na, is charged as particles in apertures 603 and melted by heating to a temperature of 630° C. The melted phosphor is cooled, whereby a number of thin phosphor columns are formed. When the phosphor is cooled down, a small gap is formed between each phosphor column 604 and stainless steel wall 602 due to a difference in the coefficient of thermal expansion. Since a plurality of thin mesh plates 601 are laminated to form groups of apertures 603 and individual mesh walls 602 have thick at the central portion, the surrounded phosphor columns 604 will never be detached.

Transparent protective film 620 containing $In_2O_3$ as a main component is formed by means of spattering on the inner surface of fluorescent layer 600 having the above structure, and photoelectric layer 630 made of well-known Cs-Sb is formed on protective film 620.

The operation of the above X-ray fluorescent intensifier according to the invention will be described.

As shown above, input screen 60 consists of 10 laminated stainless steel plates 50 μm thick and having a number of apertures with a porosity of 90% and arranged at a pitch (center-to-center spacing) of 100 μm. CsI is molten and cooled to fill these apertures. Therefore, the individual CsI columns are substantially 90 μm in diameter and 500 μm long, and they are all directed toward the focal point of the X-ray tube. For this reason, commonly called direct X-rays 605 incident from the focal point of the X-ray tube and transmitted through the object are substantially perfectly absorbed by the CsI columns. Further, scattered X-rays generated in the object and/or input window 20 are absorbed by walls 602 so that they can hardly reach the depth deep portion of the CsI columns. Further, since the porosity is as high as 90%, the effective utility of direct X-rays 605 may be held at approximately 90%. However, this does not give rise to any problem for the stopping power of the X-ray tube (the X-ray absorption coefficient multiplied by the distance) is high because of the large length of the CsI columns. Incidentally, when two mesh plates are laminated, the thickness d of a phosphor layer is 100 μm which corresponds to the minimum thickness of the phosphor layer in the present invention.

Fluorescent light 606 that is generated when direct X-rays 605 are incident on individual phosphor columns 604 are substantially perfectly reflected by walls 602, and as it is repeatedly reflected, it eventually reaches the inner surface of phosphor layer 600. Then, it is transmitted through protective film 620 to reach photocathode 630, thus causing emission of photoelectrons.

As has been shown, with input screen 60 noted above the thickness d of phosphor layer 600 can be increased to be more than 500 μm, e.g., 1,000 μm, so that it is possible to increase direct X-rays substantially by 100%. Further, since the width W of walls 602 of mesh plate 601 corresponds to direct X-ray absorbance of 10% or below, an effect of improvement of approximately 20% can be obtained when it is considered that the X-ray absorbance of the prior art X-ray fluorescent image intensifier is 70% or below. Thus, a photon noise reduction of approximately 10% can be obtained with respect to the same amount of incident X-rays.

Figure 7:
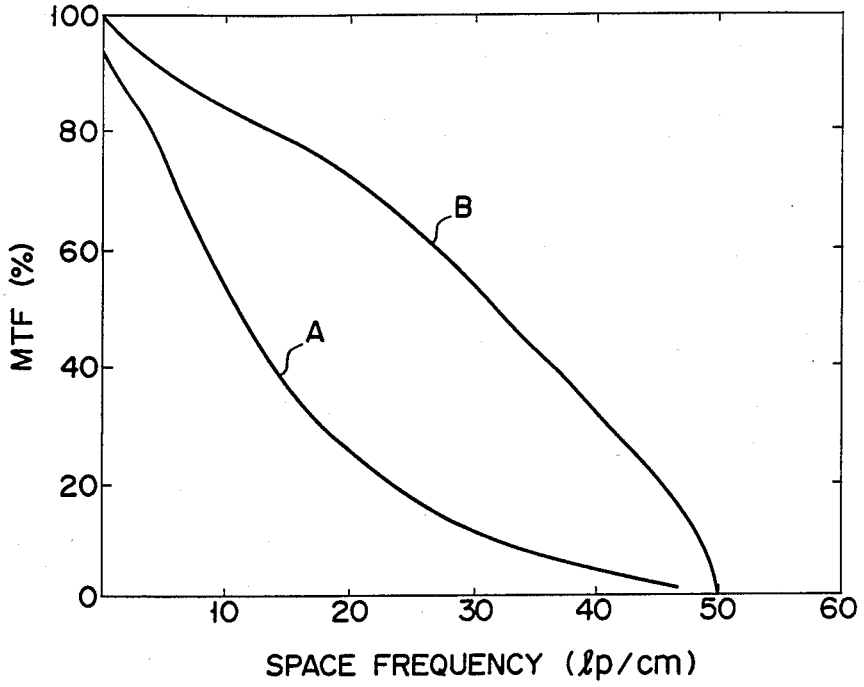
FIG. 7 is a graph showing the characteristics of one embodiment of the X-ray fluorescent image intensifier according to the invention.

Further, fluorescent light generated in each phosphor column 604 is substantially perfectly reflected by walls 602 and does not reach other phosphor columns 604, so that crosstalk can be eliminated. It is thus possible to obtain an output image having very high contrast. This fact will be described in detail with reference to FIG. 7. FIG. 7 shows the MTF of the image obtained by the X-ray fluorescent image intensifier in terms of the input surface. Curve A in the FIGURE represents the MTF of the prior art X-ray fluorescent image intensifer, and curve B the MTF of the X-ray fluorescent image intensifier according to the invention. Crosstalk is very small due to the reasons noted above, so that the MTF is improved, i.e., at least doubled, at a space frequency of 20 to 30 lp/cm. This fact means an improvement of the contrast as noted above.

Further, since the pitch of apertures 603 is 100 μm, the cut-off frequency is 50 lp/cm. It is possible to further reduce the pitch, e.g., to 50 μm. In this case, the cut-off frequency can be increased to up to 100 lp/cm.

Further, since phosphor columns 604 are melted to be homogeneous, they have a high light permeability and can effectively propagate the fluorescent light generated in their inside. It is thus possible to obtain a high sensitivity.

Further, since the input substrate is obtained by laminating mesh plates 601 obtained by etching thin metal plates, it is possible to realize an inexpensive product.

FIGS. 8 to 12 illustrate various modifications of the input screen. With these input screens the same effects as with the input screen shown in FIGS. 6A and 6B.

Figure 8:
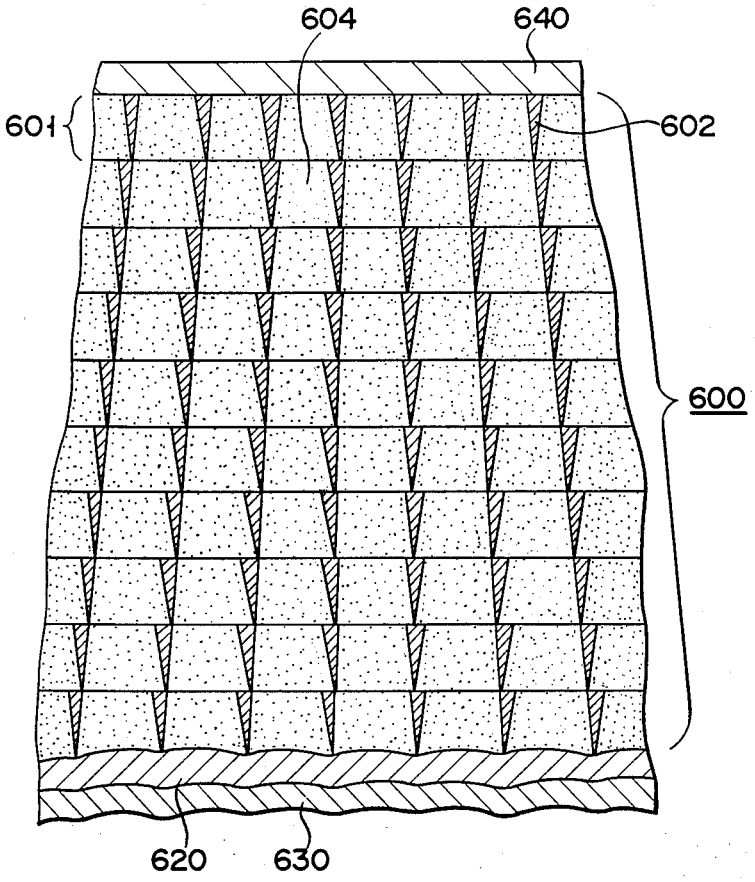
FIG. 8 is a fragmentary sectional view showing a different example of the input screen in one embodiment of the X-ray fluorescent image intensifier according to the invention.

The example of input screen shown in FIG. 8 is obtained by laminating 10 mesh plates 601 having been etched on one side. For the sake of reinforcement, reinforcement plate 640 made of a material having a high X-ray transmittivity is used. This structure permits phosphor columns 604 to be fixed more easily. Aluminum, titanium or the like may be used as the material of reinforcement plate 604.

Figure 9A:
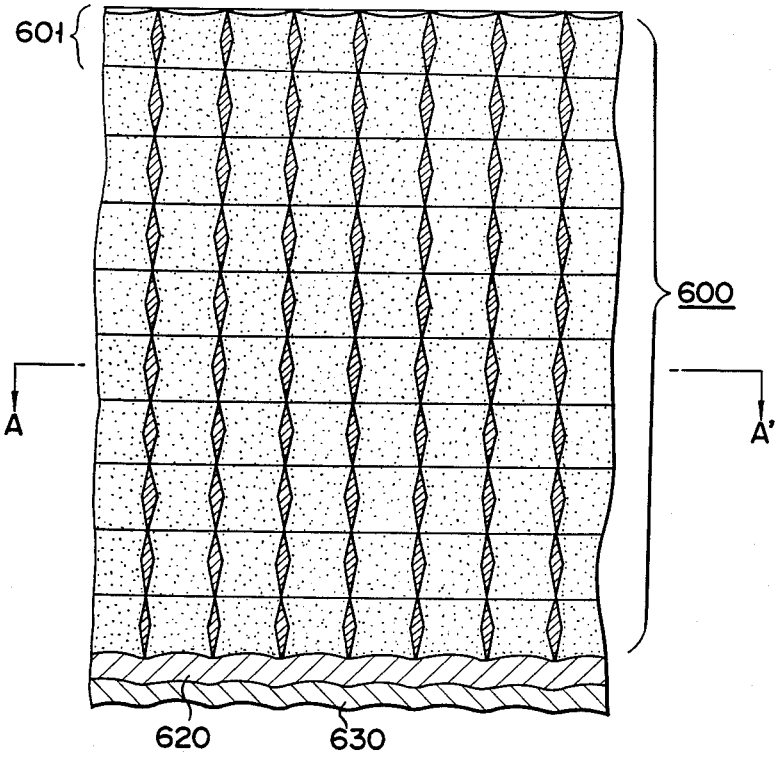
FIGS. 9A and 9B are fragmentary sectional views showing a further example of one embodiment of the X-ray fluorescent image intensifier according to the invention.
Figure 9B:
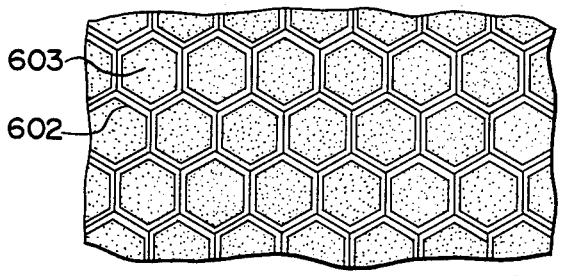

FIG. 9A is a fragmentary sectional view showing an input screen with phosphor layer 600, which is formed by laminating 10 mesh plates 601 with the same pitch of apertures 603 and filling apertures 603 with CsI, and FIG. 9B is a section taken along line A—A' in FIG. 9A. This input screen can be readily manufactured, so that it is possible to realize a high contrast X-ray fluorescent image intensifier at a low cost.

Figure 10A:
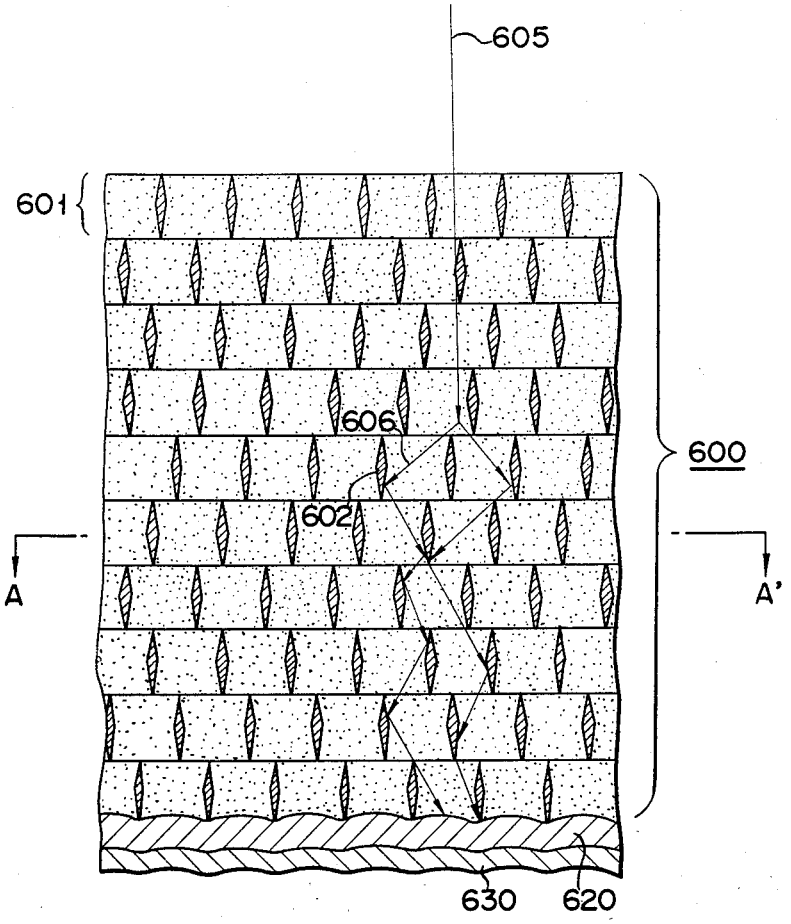
FIGS. 10A and 10B are fragmentary sectional views showing a further example of one embodiment of the X-ray fluorescent image intensifier according to the invention.
Figure 10B:
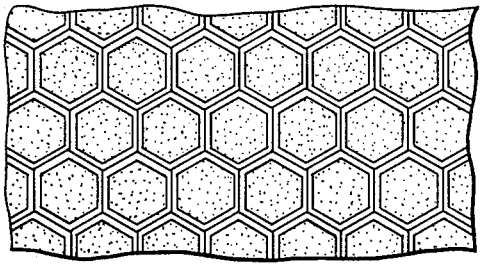

In the input screen shown in FIGS. 10A and 10B, individual mesh plates 601 are the same as in the input screen shown in FIGS. 9A and 9B. However, 10 mesh plates are laminated randomly without aligning the apertures of adjacent mesh plates 601. For the rest, this example of input screen is the same as the input screen shown in FIGS. 9A and 9B.

Now, the operation of the input screen shown in FIGS. 10A and 10B will be described in case when the input screen is illuminated by X-rays. When direct X-rays 605 are incident on phosphor layer 600, light 606 is produced in the phosphor, and it is reflected substantially perfectly and repeatedly by walls 602. In this way, it passes through protective film 620 to reach photocathode 630. Light directed to other directions behaves in the same way to reach the photoelectric layer 630. Since CsI used here is melted, very high light transmittance can be obtained. Further, since walls 602 of mesh plates 601 are made of stainless steel and polished such that the surface has luster, the reflectivity is very high, the attenuation of light 606 is held to be very low irrespective of a large number of reflections. Further, a collimation effect at walls 602 eliminates scattering of light, i.e., spread of light in a wide area. Thus, it is possible to realize very high contrast compared to the prior art X-ray fluorescent image intensifier.

Further, in the input screen shown in FIGS. 10A and 10B the resolution and utility of X-rays can be further improved by reducing the pitch a of apertures 603 and thickness W of walls 602 compared to the cases of the other screens.

Further, with the input screen shown in FIGS. 10A and 10B, mesh plates 601 can be readily aligned, so that it is possible to reduce cost.

Further, if mesh plates 601 in the above embodiments and modifications are made of a heavy metal, e.g., tungsten, it is possible to further improve the X-ray collimation effect, so that it is possible to obtain a more clear image.

In the above examples, the input substrate is formed by laminating a plurality of mesh plates. However, these examples are by no means limitative, and it is possible to form an input substrate by forming a mesh layer by depositing a metal on the mesh plate.

Now, an example in such a case will be described.

Figure 11:
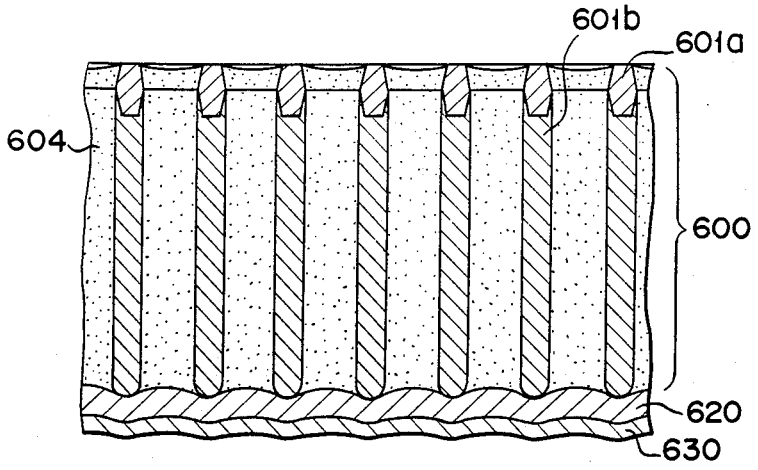
FIG. 11 is a fragmentary sectional view showing an input screen of a different embodiment of the X-ray fluorescent image intensifier according to the invention.

FIG. 11 shows an input screen, which is obtained by forming mesh layer 601*b* on the concave surface of mesh plate 601*a* like that used in the above examples by depositing a metal, e.g., aluminum, by means of evaporation. Mesh plate 601*a* and mesh layer 601*b* form an input substrate having a plurality of through holes. In this case, mesh layer 601*b* has an effect of partition walls.

Figure 12:
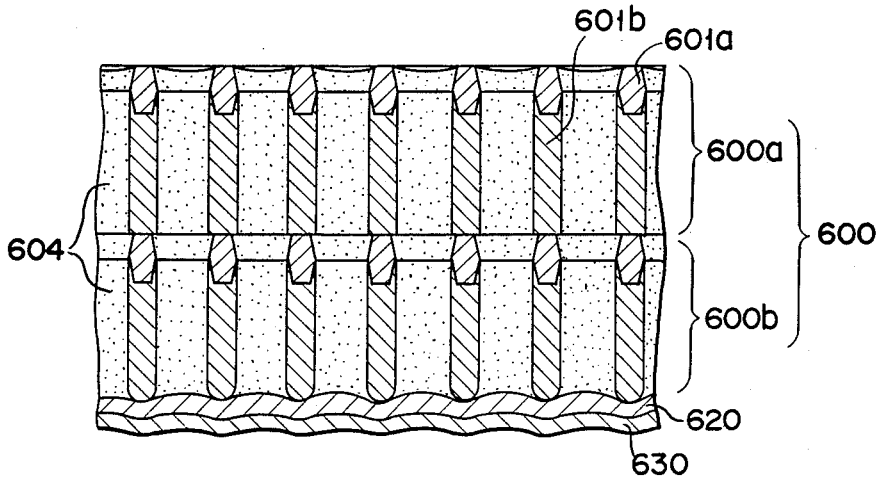
FIG. 12 is a sectional view showing a different example of the input screen in the different embodiment of the X-ray fluorescent image intensifier according to the invention.

FIG. 12 shows an input screen, which has phosphor layer 600 having a two-layer structure by laminating phosphor layers 600*a* and 600*b* having a structure shown in FIG. 11. Protective layer 620 and photoelectric screen 630 are formed on the surface of phosphor layer 600.

According to the invention, it is possible to obtain the following excellent effects.

More particularly, it is possible to remove scattered X-rays generated in object 3 and input window 20 of X-ray fluorescent image intensifier. As a result, it is possible to increase the contrast of image and obtain a clear image.

Further, light generated in phosphor layer 600 reaches photocathode 630 very efficiently and without being spread to other places by the lightguide effect due to walls 602, so that the MTF at intermediate space frequencies of, for instance, 501 lp/cm can be improved to be more than double the value in the prior art to obtain high contrast clear images. Further, since phosphor layer 600 is formed by melting, it has high transparency and thus it is possible to obtain an X-ray fluorescent image intensifier, which has higher sensitivity.

Further, since phosphor layer 600 is formed by laminating mesh plates 601 or depositing metal, it may be made as thick as desired, and the X-ray absorbance in phosphor layer 600 may be increased up to approximately 100%. It is thus possible to reduce photon noise with respect to the same input X-ray dose.

Further, since phosphor layer 600 consists of melted CsI, it has a smooth surface, so that protective film 620 formed on phosphor layer 600 and photocathode 630 formed on protective film 620 have smooth surface. Thus, satisfactory cathode electrode function can be obtained, and photoelectrons from the surface of photocathode 30 initially emit in the same direction and are satisfactorily focused by electron lenses to produce a clear image.

In addition to the above effects, the input substrate is formed by laminating a plurality of mesh plates 601 consisting of etched thin plates or depositing metal on mesh plates, so that it can be industrially realized at a low cost.

I claim:

1. An X-ray fluorescent image intensifier comprising:

an input screen for emitting photoelectrons responsive to an incident X-ray image, said input screen including an input substrate which is constituted by a lamination of a plurality of mesh plates having a plurality of apertures having walls which are thicker in the central portion of the walls than at the peripheral portion of the walls, said input screen further having a plurality of through holes constituted by interconnection of said apertures and Na-activated CsI phosphor particles buried in said through holes and a photocathode formed on said input substrate;

means for accelerating and focusing said photoelectrons;

an output screen for displaying responsive to said accelerated and focused photoelectrons, an optical image.

2. The X-ray fluorescent image intensifier according to claim 1, wherein the pitch of said apertures formed in said mesh plate ranges from 10 to 200 μm.

3. The X-ray fluorescent image intensifier according to claim 2, wherein the pitch of apertures formed in said mesh plates ranges from 50 to 150 μm.

4. The X-ray fluorescent image intensifier according to claim 1, wherein the thickness of walls defining said apertures ranges from 2 to 10 μm.

5. The X-ray fluorescent image intensifier according to claim 1, wherein the thickness of said laminated mesh plates ranges from 100 to 1,000 μm.

6. The X-ray fluorescent image intensifier according to claim 1, wherein the pitch of apertures corresponding to said plurality of mesh plates is gradually increased toward said photocathode such that said through holes are directed toward an X-ray source.

7. The X-ray fluorescent image intensifier according to claim 1, wherein the pitch of said apertures is gradually increased toward the edges of said mesh plates.

8. The X-ray fluorescent image intensifier according to claim 1, wherein the pitch of said apertures is the same for all the mesh plates.

9. The X-ray fluorescent image intensifier according to claim 1, wherein the positions of corresponding apertures of said adjacent mesh plates are aligned.

10. The X-ray fluorescent image intensifier according to claim 1, wherein the positions of corresponding apertures of said adjacent mesh plates are at random.

11. The X-ray fluorescent image intensifier according to claim 1, wherein said input substrate is formed on said supporting substrate.

* * * * *